US011433517B2

(12) United States Patent
Hsieh

(10) Patent No.: US 11,433,517 B2
(45) **Date of Patent: *Sep. 6, 2022**

(54) TORQUE WRENCH WITH ELASTIC MEMBER

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 282 days.

This patent is subject to a terminal disclaimer.

(21) Appl. No.: 16/260,434

(22) Filed: Jan. 29, 2019

(65) Prior Publication Data

US 2019/0299376 A1 Oct. 3, 2019

(30) Foreign Application Priority Data

Apr. 2, 2018 (TW) ..... 107111576

(51) Int. Cl.
*B25B 23/142* (2006.01)

(52) U.S. Cl.
CPC ..... *B25B 23/1427* (2013.01)

(58) Field of Classification Search
CPC . B25B 23/1427; B25B 23/1422; B25B 17/02; B25B 13/00; B25B 23/14; B25B 23/141; Y10S 81/90
USPC ..... 81/480–483
See application file for complete search history.

(56) References Cited

U.S. PATENT DOCUMENTS 2,517,269 A * 8/1950 Wolfe ..... F16F 1/02 267/182
3,482,872 A * 12/1969 Chamberlain ..... B60R 22/28 297/472
4,403,531 A * 9/1983 Bailey ..... B25B 23/1427 81/483
6,469,430 B1 * 10/2002 Saita ..... H01J 29/073 313/402
2006/0027049 A1 * 2/2006 Arnold ..... B25B 13/463 81/60
2014/0373691 A1 * 12/2014 Lin ..... B25B 13/06 81/480
2020/0384615 A1 * 12/2020 Ruetschi ..... B25B 13/462

* cited by examiner

*Primary Examiner* — Monica S Carter
*Assistant Examiner* — Sarah Akyaa Fordjour
(74) *Attorney, Agent, or Firm* — Guice Patents PLLC

(57) ABSTRACT

A torque wrench with elastic member includes a tubular body in which an elastic member is disposed for adjusting the torque value of the torque wrench. The elastic member is in the form of a plate body having a front connection section, a rear connection section and at least one bent section positioned between the front and rear connection sections. The front and rear connection sections of the elastic member respectively abut against a click mechanism disposed in front of the elastic member and an adjustment mechanism disposed behind the elastic member, whereby the elastic member can be compressed or released to adjust the torque value of the torque wrench. The elastic member has a novel structure and can ensure the stability of the torque wrench in use and enhance the utility of the torque wrench.

13 Claims, 9 Drawing Sheets

TORQUE WRENCH WITH ELASTIC MEMBER

BACKGROUND OF THE INVENTION

1. Field of the Invention

The present invention relates generally to a wrench, and more particularly to a torque wrench with a novel elastic member.

2. Description of the Related Art

A torque wrench is used to tighten/untighten a threaded member. The set torque value of the torque wrench can be adjusted so as to control the tightening extent of the threaded member. Especially to a special or important apparatus, the structures of the components of the apparatus necessitate precise and correct tightening extent. Therefore, the torque value of the torque wrench is preset to tighten the sophisticated components of the apparatus in accordance with the necessary mechanical properties of the apparatus so as to meet the security regulation and ensure the normal operation of the apparatus.

The conventional torque wrenches can be substantially classified into two types, that is, electronic torque wrench and mechanical torque wrench. With respect to the mechanical torque wrench, an elastic member is disposed in the torque wrench to provide elastic force for creating torque. By means of compressing or releasing the elastic member, the torque wrench can be adjusted to a necessary torque value so that the torque wrench can be used to precisely tighten/untighten various threaded members or components.

The mechanical torque wrench has been developed long since so that the existent mechanical torque wrench has fixed internal structure. For example, the current mechanical torque wrench generally employs a coiled spring as the elastic member. However, such conventional adjustment structure is not novel and inventive. As a result, the torque wrench cannot be further developed and improved.

SUMMARY OF THE INVENTION

It is therefore a primary object of the present invention to provide a torque wrench with elastic member, which has a novel configuration.

It is a further object of the present invention to provide the above torque wrench with elastic member, which can be stably used.

To achieve the above and other objects, the torque wrench with elastic member of the present invention includes:

a tubular body having a passage extending through the tubular body in an axial direction of the tubular body;

a working head disposed at a front end of the tubular body, a rear end of the working head being positioned in the passage of the tubular body;

a click mechanism positioned behind the working head for providing a warning for a user;

an elastic member including a front connection section, a rear connection section and at least one bent section positioned between the front and rear connection sections, the front connection section of the elastic member serving to apply elastic force to the click mechanism; and an adjustment mechanism disposed in the passage of the tubular body, the rear connection section of the elastic member serving to apply elastic force to the adjustment mechanism, whereby the adjustment mechanism can change the elastic energy of the elastic member.

Preferably, the elastic member forms a U-shaped configuration, an N-shaped configuration, an S-shaped configuration, an M-shaped configuration, a waved configuration or the like configuration.

Preferably, each of the bent sections of the elastic member has an arched form.

Preferably, the front and rear connection sections of the elastic member are in the form of a plane plate, whereby the front and rear connection sections are respectively in contact with the click mechanism and the adjustment mechanism by a plane face or a non-plane face.

According to the above arrangement, the structure and configuration of the elastic member of the present invention not only are novel and unique, but also can achieve the torque adjustment effect as the conventional coiled spring. Moreover, the elastic member of the present invention can ensure the stability of the torque wrench in use and enhance the utility of the torque wrench.

The present invention can be best understood through the following description and accompanying drawings, wherein:

DETAILED DESCRIPTION OF THE PREFERRED EMBODIMENTS

Figure 1:
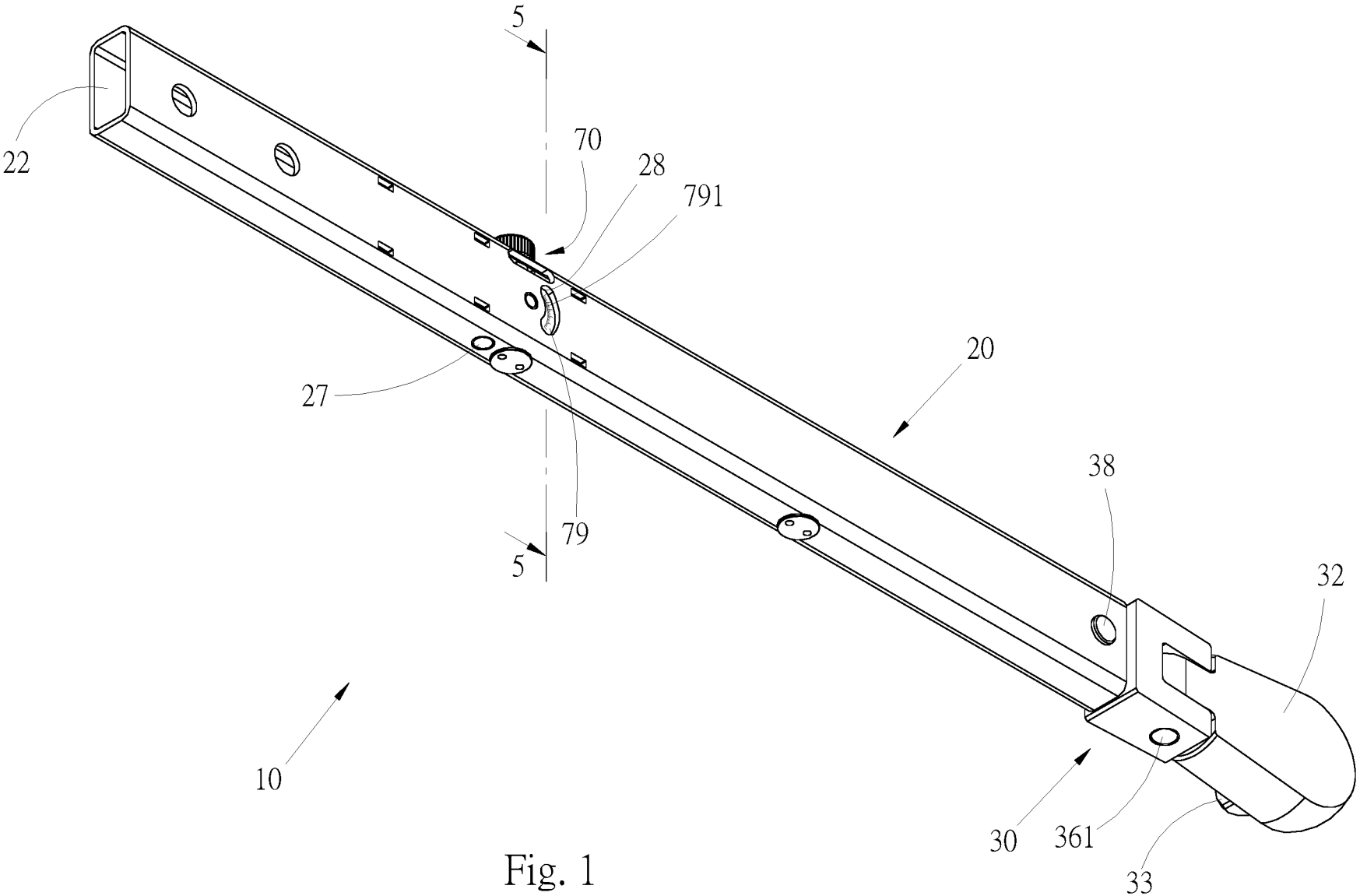
FIG. 1 is a perspective assembled view of a first embodiment of the torque wrench of the present invention.
Figure 2:
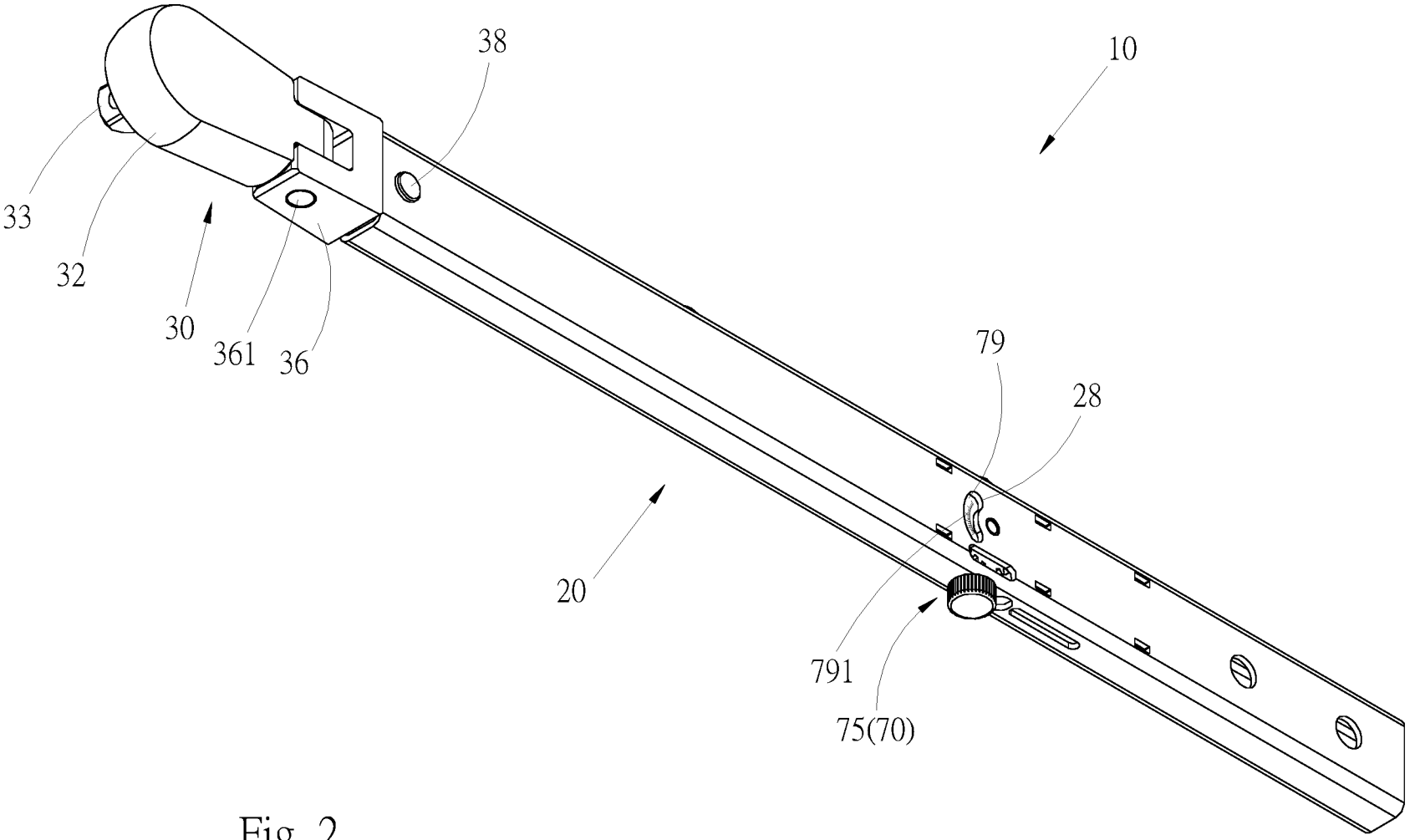
FIG. 2 is a perspective assembled view of the first embodiment of the torque wrench of the present invention according to FIG. 1, seen in another direction.
Figure 3:
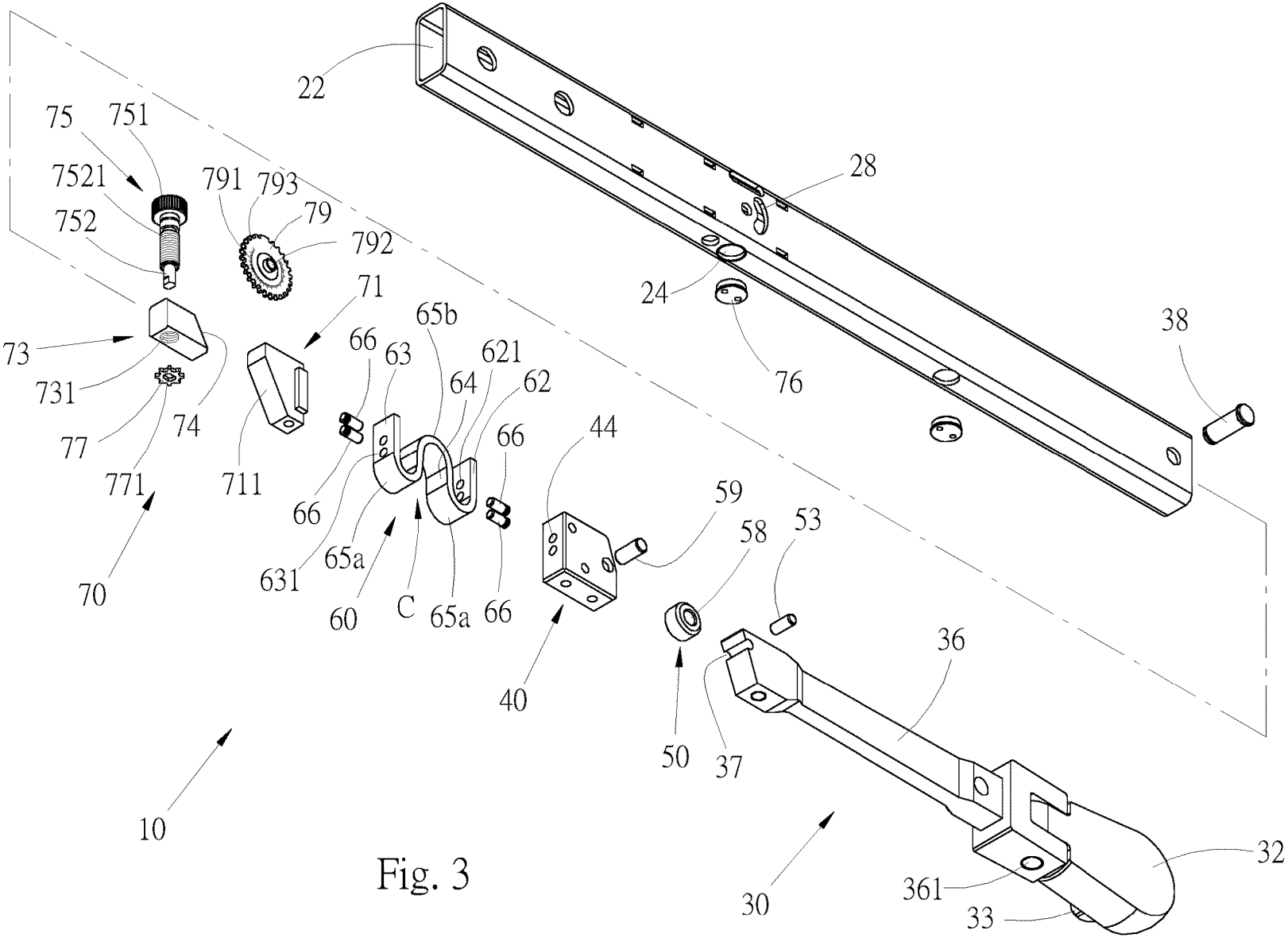
FIG. 3 is a perspective generally exploded view of the first embodiment of the torque wrench of the present invention according to FIG. 1.
Figure 4:
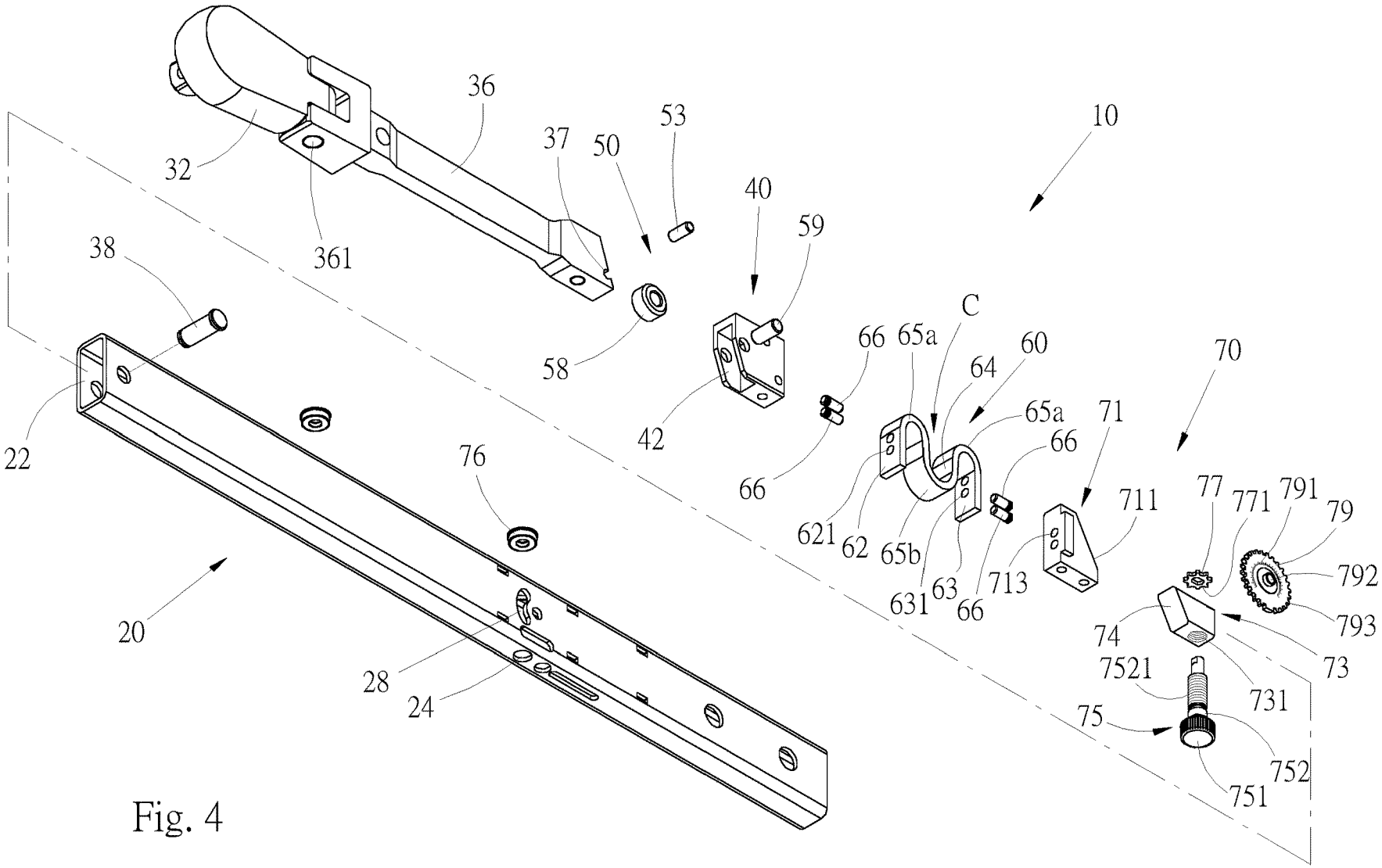
FIG. 4 is a perspective generally exploded view of the first embodiment of the torque wrench of the present invention according to FIG. 3, seen in another direction.

Please refer to FIGS. 1 to 4, which show a first embodiment of the torque wrench 10 with elastic member of the present invention. In order to facilitate understanding of the technical content of the present invention, the front, rear, left, right, top and bottom sides referred to hereinafter are recited with reference to the direction of FIG. 1. The torque wrench 10 includes a tubular body 20, a working head 30, a click mechanism 50, an elastic member 60 and an adjustment mechanism 70.

In this embodiment, the tubular body 20 has a rectangular cross section, and includes a passage 22, a perforation 24 and a window 28. The passage 22 is a rectangular passage extending through the tubular body 20 in an axial direction of the tubular body 20 between two ends thereof. The perforation 24 is formed through two sidewalls of the tubular body 20 in communication with the passage 22. In this embodiment, the window 28 is an arched hole disposed on the top wall of the tubular body 20 in communication with the passage 22.

The working head 30 includes a head section 32 and a stem section 36. The head section 32 of the working head 30 is for driving a work piece. In this embodiment, the head section 32 has an insertion column 33 for fitting with a socket for driving a threaded member (a bolt or a nut). The head section can have an otherwise form, for example, but not limited to, a polygonal socket for fitting with a threaded member. The stem section 36 is disposed behind the head section 32. A front end of the stem section 36 is pivotally connected with a rear end of the head section 32 via a pivot shaft 361, whereby the head section 32 can rotate around the pivot shaft 361. The working head 30 is disposed at the front end of the tubular body 20. The stem section 36 is fitted into the passage 22 of the tubular body 20 and pivotally connected with the tubular body 20 via a shaft pin 38 with the head section 32 protruding from the front end of the tubular body 20.

The click mechanism 50 is disposed between the rear end of the stem section 36 of the working head 30 and the elastic member 60. When the applied force of the wrench exceeds a set torque value, the click mechanism 50 will provide a warning to notice a user that the applied force of the wrench has reached the set torque value. The click mechanism 50 can have different forms. This embodiment only discloses one form of click mechanism and is not intended to limit the form of the click mechanism 50. The click mechanism 50 includes a base 40, an abutment member 53 and a roller 58. The base 40 has a substantially rectangular cross section in adaptation to the configuration of the tubular body. The base 40 is movably received in the passage 22 of the tubular body 20 and positioned behind the stem section 36 of the working head 30. The abutment member 53 is disposed in a notch 37 of the stem section 36 to partially protrude from the rear end of the stem section 36. The roller 58 is pivotally connected in a cavity 42 of the front end of the base 40 via a pivot shaft 59 to slightly protrude from the front end of the base 40. Accordingly, in normal state, the abutment member 53 abuts against one side of the roller 58. When the wrench reaches the set torque value, the click mechanism 50 will click, whereby the abutment member 53 passes over the foremost end of the roller 58 to abut against the other side of the roller 58. The click mechanism 50 pertains to prior art and thus will not be redundantly described hereinafter.

The elastic member 60 forms a substantially M-shaped configuration and is made of an elastic plate material. The elastic member 60 has a front connection section 62, a rear connection section 63, two interconnection sections 64 and three bent sections 65, that is, two (outer) bent sections 65*a* positioned at two ends of the elastic member and an inner bent section 65*b* positioned in the elastic member. The inner bent section 65*b* is positioned between the two (outer) bent sections 65*a*. By means of the design of the bent sections 65, the elastic member can provide elastic effect. The front and rear connection sections 62, 63 are substantially plate-shaped and respectively positioned at a front end and a rear end of the elastic member. Preferably, the front and rear connection sections 62, 63 are parallel to each other. Preferably, the three bent sections 65 have an arched form, wherein one end (a front end) of the outer bent section 65*a* at the front end of the elastic member is connected with one end of the front connection section 62, one end (a rear end) of the outer bent section 65*a* at the rear end of the elastic member is connected with one end of the rear connection section 63. Two ends of the inner bent section 65*b* are connected with the two interconnection sections 64 and respectively indirectly connected to the other ends of the two outer bent sections 65*a* via the two interconnection sections 64. In practice, two ends of the inner bent sections 65*b* can be directly connected with the other ends of the two outer bent sections 65*a*. The two outer bent sections 65*a* are positioned on the same side of the elastic member, and the inner bent section 65*b* is positioned on the other side of the elastic member. The elastic member 60 is disposed in the passage 22 of the tubular body 20. The front connection section 62 abuts against and attaches to a rear end face of the base 40 of the click mechanism 50. In this embodiment, four pin-like connection members 66 are provided, wherein two first connection members 66 are passed through two bores 621 of the front connection section 62. One end of each first connection member 66 is inserted in a connection hole 44 formed at the rear end of the base 40, whereby the front connection section 62 is positioned at the rear end of the base 40 without laterally deflecting. In this case, it is ensured that the front connection section 62 is in contact with the rear end face of the base 40.

In this embodiment, the elastic member 60 forms an M-shaped configuration with three bent sections (the three bent sections 65). The two interconnection sections 64 and the inner bent section 65*a* form a middle portion C of the elastic member 60. In this embodiment, the middle portion C has one bent section, (that is, the inner bent section 65*b*), which is connected to the two (outer) bent sections 65*a*. It should be noted that in practice, the middle portion C can have multiple bent sections, that is, the middle portion C can include multiple inner bent sections 65*b*.

Figure 5:
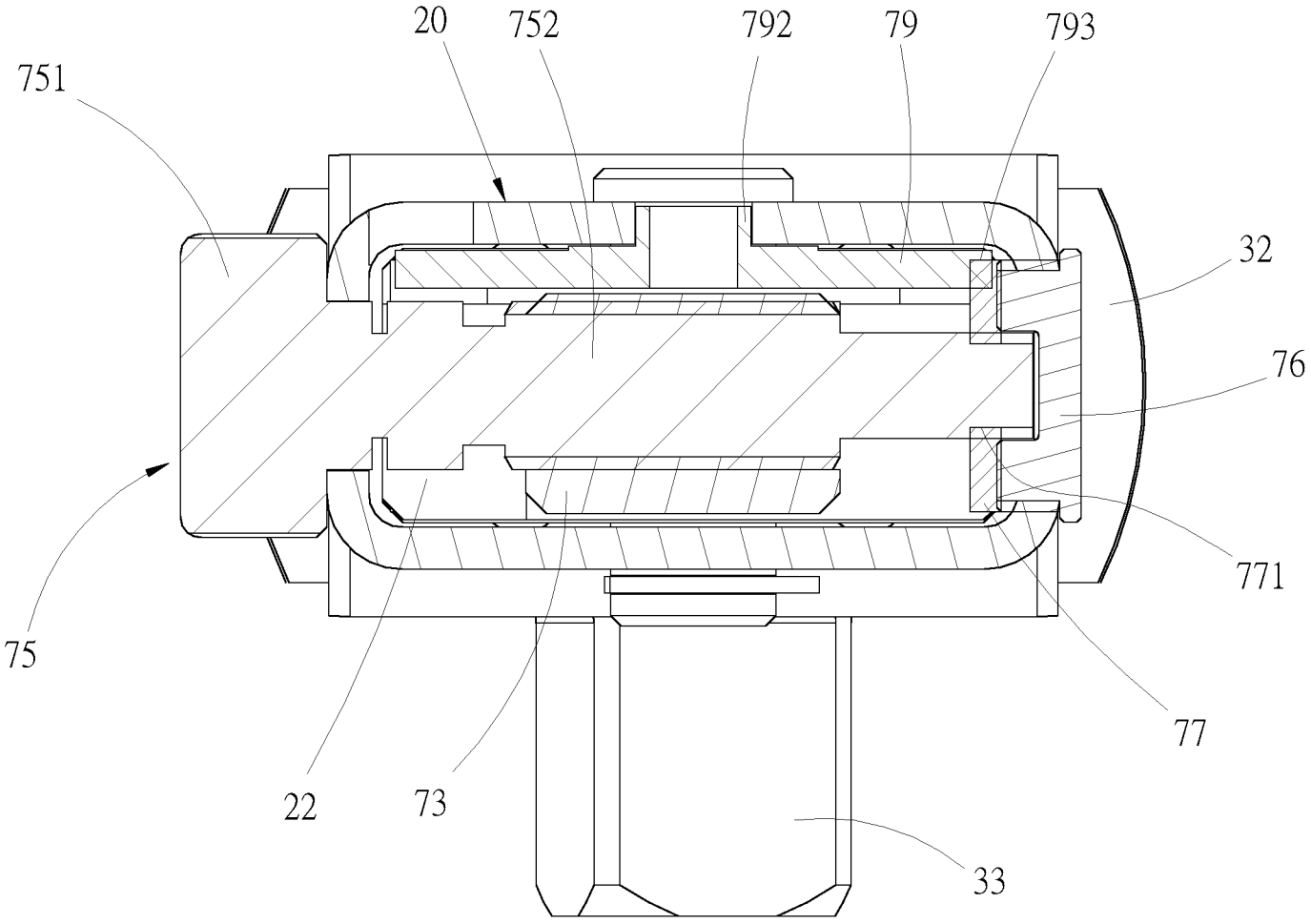
FIG. 5 is a sectional view taken along line 5-5 of FIG. 1.
Figure 6:
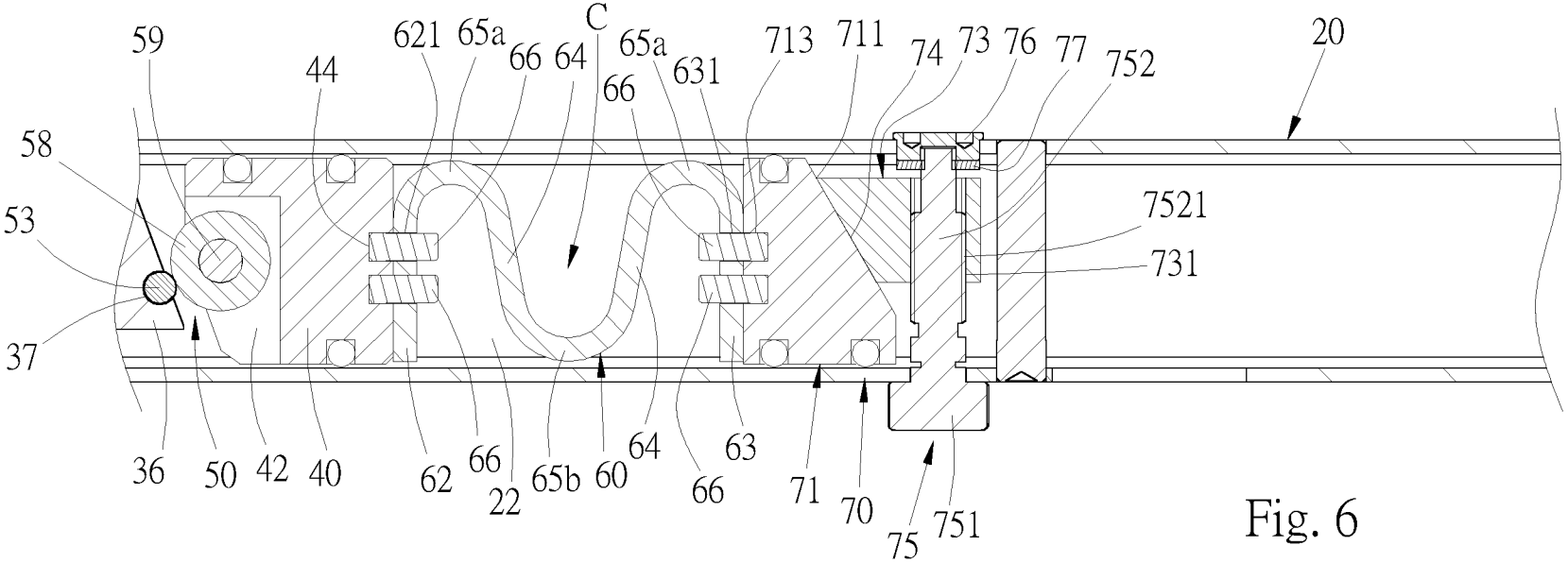
FIGS. 6 and 7 are longitudinally sectional views of the first embodiment of the torque wrench of the present invention according to FIG. 1, showing that the elastic member is compressed or released.

Please refer to FIGS. 5 and 6, the adjustment mechanism 70 is disposed in the passage 22 of the tubular body 20 and positioned behind the elastic member 60. The adjustment mechanism 70 includes an abutting member 71, an adjustment member 73, a rotary button 75, an outer cap 76, a gear 77 and a scale disc 79. The abutting member 71 is in a substantially rectangular form and has a first slope 711 disposed on a rear end face of the abutting member 71. The abutting member 71 is displaceable within the passage 22. The rear connection section 63 of the elastic member 60 attaches to and abuts against a front end face of the abutting member 71. Two second connection members 66 are passed through two bores 631 of the rear connection section 63. One end of each second connection member 66 is inserted in a connection hole 713 formed at the front end of the abutting member 71, whereby the rear connection section 63 will not laterally deflect relative to the abutting member 71. In this case, it is ensured that the rear connection section 63 is in contact with the front end face of the abutting member 71.

The adjustment member 73 is also in a substantially rectangular form and has a threaded hole 731 and a second slope 74. The threaded hole 731 transversely passes through the adjustment member 73. The second slope 74 is disposed on a front end face of the adjustment member 73. The adjustment member 73 is positioned behind the abutting member 71 with the second slope 74 attaching to the first slope 72 of the abutting member 71. The rotary button 75 includes a head section 751 and a stem body 752. One end of the stem body 752 is connected with the head section 751. The stem body 752 is formed with threads 7521. The rotary button 75 passes through the perforation 24 of the tubular body 20 and is rotatable within the perforation 24. The head section 751 is positioned outside a sidewall of the tubular body 20. The threads 7521 of the stem body 752 are screwed in the threaded hole 731 of the adjustment member 73. The outer cap 76 is disposed at the other end of the perforation 24. The gear 77 is positioned on an inner wall face of a sidewall of the tubular body 20. A free end of the stem body 752 is fitted through a hole 771 of the gear 77, whereby the gear 77 is drivable by the rotary button 75 to rotate therewith. A surface of the scale disc 79 is marked with scales 791. In this embodiment, the scales 791 are torque values. The scale disc 79 is pivotally rotatably disposed on the inner wall face of the top wall of the tubular body 20 via a pivot shaft 792. The scale disc 79 has a toothed section 793 along the circumference for engaging with the gear 77. Accordingly, the scale disc 79 is drivable by the gear 77 to rotate, whereby a user can observe the displayed scale of the scale disc 79 through the window 28 of the tubular body 20.

Figure 7:
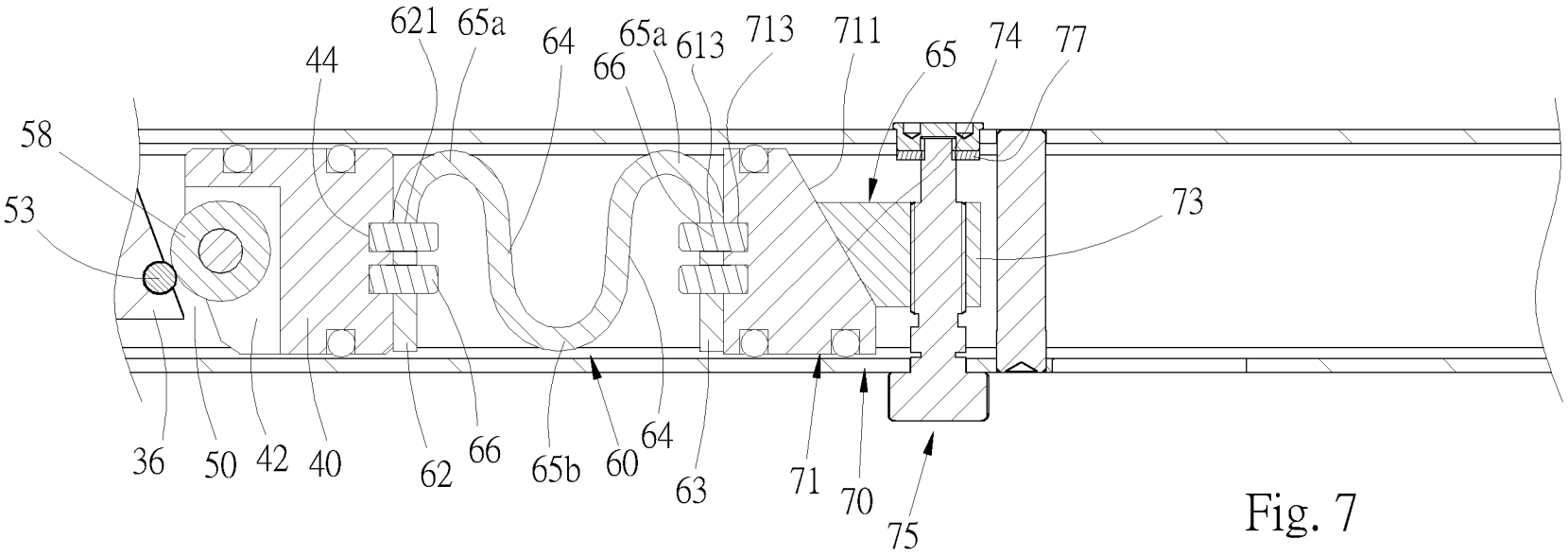
Figure 8:
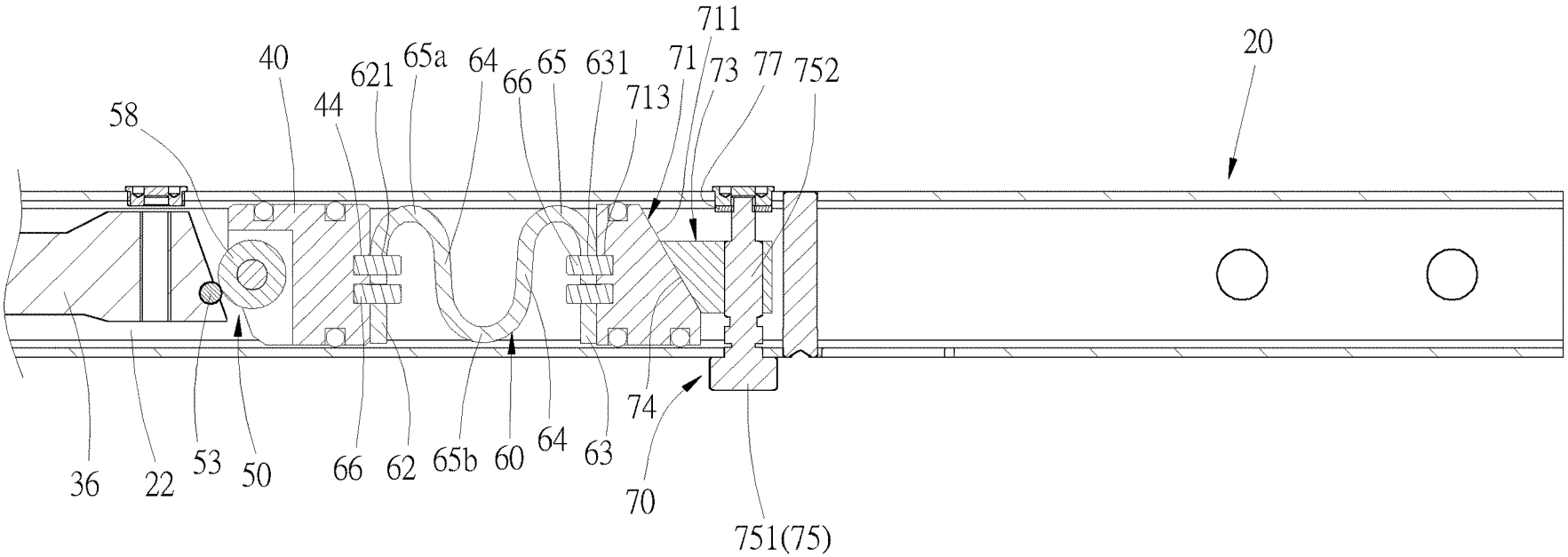
FIG. 8 is a longitudinally sectional view of the first embodiment of the torque wrench of the present invention according to FIG. 1.

As aforesaid, the threads 7521 of the rotary button 75 are cooperatively screwed in the threaded hole 731 of the adjustment member 73, therefore, when a user desires to adjust the torque value of the torque wrench 10, the user can rotate the rotary button 75. At this time, the adjustment member 73 is driven to displace within the tubular body 20 in the transverse direction thereof, whereby the position of the abutting member 71 is changed. Please refer to FIG. 6. When the adjustment member 73 is laterally displaced toward the rear end of the rotary button 75, the abutting member 71 is rearward displaced in the longitudinal direction of the tubular body to release the elastic member 60, whereby the elastic member 60 can extend rearward. In this case, the elastic member 60 with less elastic energy applies a smaller elastic force to the click mechanism 50. Please further refer to FIG. 7. When the adjustment member 73 is laterally displaced toward the head section 751 of the rotary button 75, by means of the cooperation between the first and second slopes 711, 74, the adjustment member 73 forward pushes the abutting member 71 in the longitudinal direction of the tubular body, whereby the abutting member 71 applies a force to the rear connection section 63 of the elastic member 60 to compress the elastic member 60. In this case, the elastic member 60 with greater elastic energy applies a greater elastic force to the click mechanism 50 so as to change the set torque value of the torque wrench 10. In this embodiment, the front and rear connection sections 62, 63 at two ends of the elastic member 60 have the form of a plane face in contact with the base 40 and the abutting member 71. Therefore, it is ensured that the elastic member is precisely compressed or released to provide stable elastic energy. In practice, the form of the front and rear connection sections 62, 63 in not limited to plane face. Alternatively, the front and rear connection sections 62, 63 can be in the form of arched plates. Under such circumstance, the front and rear connection sections 62, 63 are in contact with the base 40 and the abutting member 71 by a non-plane face such as an arched face or the like form.

Figure 9:
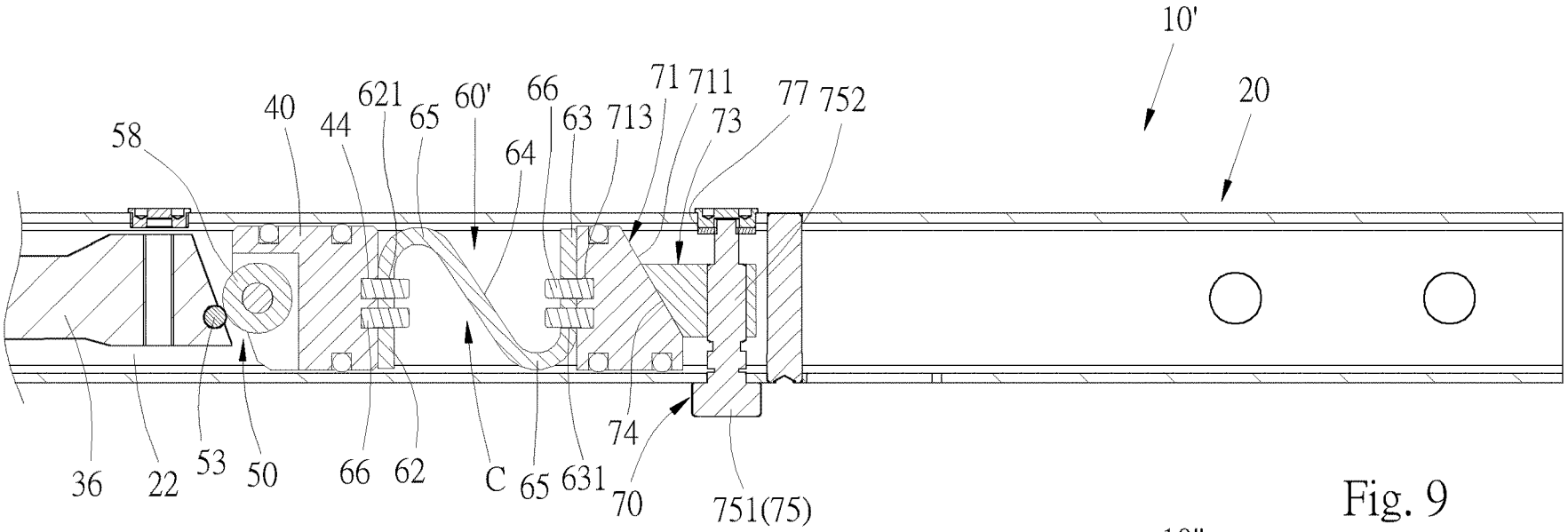
FIG. 9 is a partially longitudinally sectional view of a second embodiment of the torque wrench of the present invention.
Figure 10:
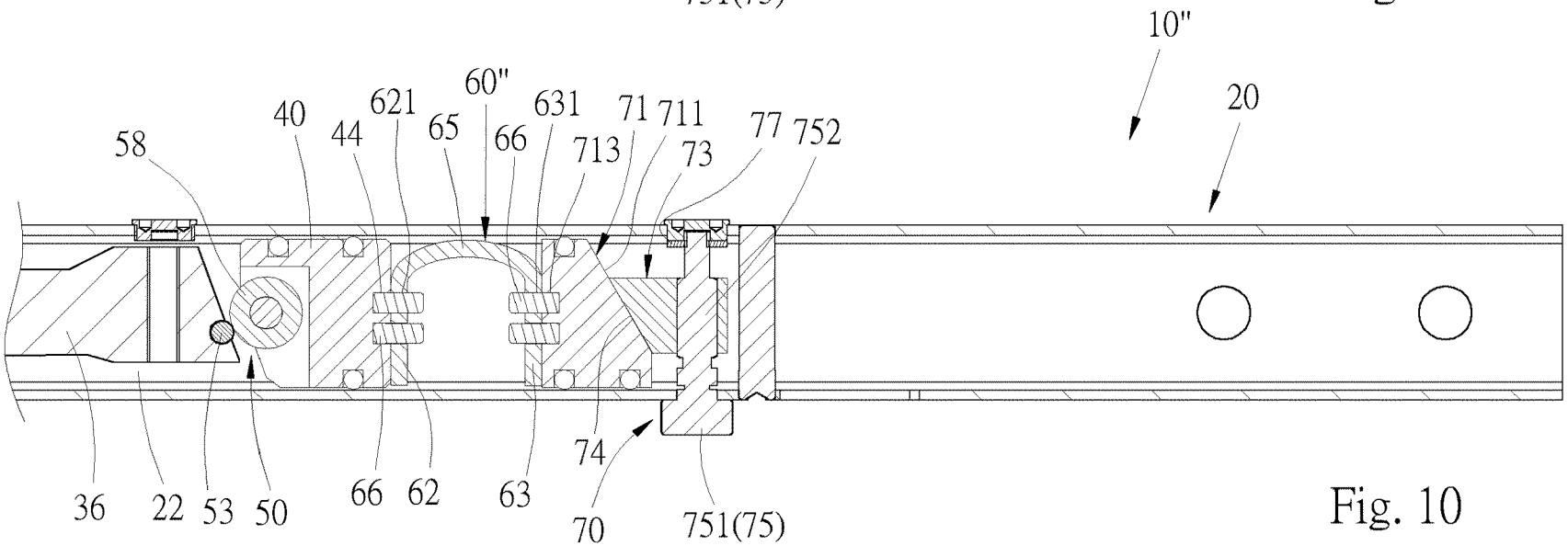
FIG. 10 is a partially longitudinally sectional view of a third embodiment of the torque wrench of the present invention.

FIGS. 9 and 10 respectively show a second embodiment and a third embodiment of the torque wrench of the present invention. The same components as the first embodiment are denoted with the same reference numerals and will not be redundantly described hereinafter. The second and third embodiments are different from the first embodiment in the elastic member.

FIG. 9 shows an elastic member 60' forming an N-shaped configuration. The elastic member 60' has a front connection section 62 in the form of a plane plate, a rear connection section 63 in the form of a plane plate, a middle portion C and two bent sections 65. One end of the two bent sections 65 is respectively connected with one end of the front and rear connection sections 62, 63. The middle portion C is an interconnection section 64. Two ends of the interconnection section 64 are respectively connected with the other ends of the two bent sections 65. Accordingly, the elastic member forms an N-shaped configuration and the two bent sections 65 are positioned on different sides of the elastic member.

It should be noted that in the second embodiment, the interconnection section 64 of the elastic member can be omitted and the other ends of the two bent sections 65 are connected with each other. Accordingly, the elastic member forms a substantially S-shaped configuration and the front and rear connection sections are in the form of a plane plate.

FIG. 10 shows an elastic member 60" forming a U-shaped configuration. The elastic member 60" has a front connection section 62, a rear connection section 63 and a bent section 65. Two ends of the bent section 65 are respectively connected with one end of the front and rear connection sections 62, 63.

Figure 11:
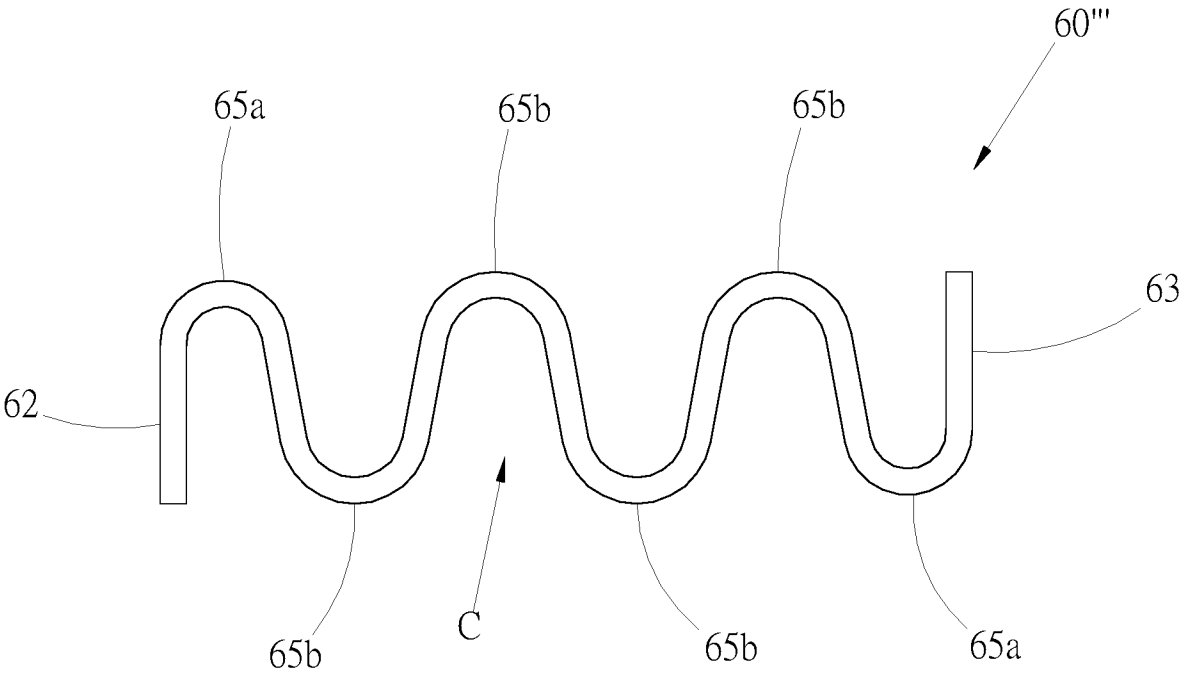
FIG. 11 is a top view of the elastic member of a fourth embodiment of the torque wrench of the present invention.

FIG. 11 shows the elastic member 60" of a fourth embodiment of the torque wrench of the present invention. The elastic member 60" has a front connection section 62, a rear connection section 63, two (outer) bent sections **65*a* and a middle portion C positioned between the bent sections 65*a*. Two ends of the middle portion are respectively connected with one end of the front and rear connection sections 62, 63. In this embodiment, the middle portion C has multiple inner bent sections 65*b* serially connected with each other. One end of the inner bent section 65*b* is directly or indirectly connected with one end of the adjacent inner bent section 65*b*. Accordingly, the elastic member 60'"** of this embodiment forms a waved configuration.

The elastic members 60', 60" and 60'" can provide the same elastic effect as the first embodiment.

The structure and configuration of the elastic member of the present invention not only are novel and unique, but also can achieve the torque adjustment effect as the conventional coiled spring. Moreover, the elastic member of the present invention can ensure the stability of the torque wrench in use and enhance the utility of the torque wrench.

The above embodiments are only used to illustrate the present invention, not intended to limit the scope thereof. Many modifications of the above embodiments can be made without departing from the spirit of the present invention.

What is claimed is:

1. A torque wrench with elastic member, comprising:

a tubular body having a passage extending through the tubular body in an axial direction of the tubular body;

a working head disposed at a front end of the tubular body, a rear end of the working head being positioned in the passage of the tubular body;

a click mechanism having a base and being disposed behind the working head for providing a warning;

an elastic member in the form of a plate-shape, the elastic member including a front connection section formed at a front end of the elastic member, a rear connection section formed at a rear end of the elastic member and at least one bent section positioned between the front and rear connection sections, the front connection section of the elastic member serving to apply elastic force to the click mechanism; and an adjustment mechanism having an abutting member and being disposed in the passage of the tubular body, the rear connection section of the elastic member serving to apply elastic force to the adjustment mechanism, whereby the adjustment mechanism can change the elastic energy of the elastic member;

wherein the front connection section of the elastic member is positioned parallel with the rear connection section of the elastic member, the front connection section of the elastic member is connected to a rear end of the click mechanism without laterally deflecting, the rear connection section of the elastic member is connected to a front end face of the adjustment mechanism;

wherein the front connection section and the rear connection section of the elastic member are in a plane form to abut against and attach to the rear end face of the base and the front end face of the abutting member respectively, and the front connection section of the elastic member is connected with the base of the click mechanism via the at least one first connection member, and the rear connection section of the elastic member is connected with the abutting member of the adjustment mechanism via the at least one second connection member.

2. The torque wrench as claimed in claim 1, wherein the elastic member has a bent section, two ends of the bent section being respectively connected with one end of the front and rear connection sections.

3. The torque wrench as claimed in claim 1, wherein the elastic member has two bent sections, one end of the two bent sections being respectively connected with one end of the front and rear connection sections, the elastic member further including a middle portion positioned between the two bent sections and connected with the two bent sections.

4. The torque wrench as claimed in claim 3, wherein the middle portion is a plate-shaped interconnection section, two ends of the interconnection section being respectively connected with the other ends of the two bent sections.

5. The torque wrench as claimed in claim 3, wherein the middle portion has at least one inner bent section, the inner bent section being directly or indirectly connected with the other ends of the two bent sections.

6. The torque wrench as claimed in claim 3, wherein the middle portion of the elastic member has at least two interconnection sections and at least one inner bent section, one end of the two interconnection sections being connected with the inner bent section, the other ends of the two interconnection sections being respectively connected with the other ends of the two bent sections.

7. The torque wrench as claimed in claim 1, wherein the elastic member has two bent sections, one end of the two bent sections being respectively connected with one end of the front and rear connection sections, the other ends of the two bent sections being connected with each other.

8. The torque wrench as claimed in claim 1, wherein each of the bent sections has an arched form.

9. The torque wrench as claimed in claim 5, wherein each of the bent sections has an arched form and the at least one inner bent section has an arched form.

10. The torque wrench as claimed in claim 1, wherein the front and rear connection sections of the elastic member are in the form of a plane plate, whereby the front and rear connection sections are respectively in contact with the click mechanism and the adjustment mechanism by a plane face.

11. The torque wrench as claimed in claim 1, wherein the front and rear connection sections of the elastic member are respectively in contact with the click mechanism and the adjustment mechanism by a non-plane face.

12. The torque wrench as claimed in claim 1, wherein the first connection member passes through the front connection section to connect with the click mechanism, and the second connection member passes through the rear connection section to connect with the adjustment mechanism.

13. The torque wrench as claimed in claim 1, wherein the elastic member forms a U-shaped configuration, an N-shaped configuration, an S-shaped configuration, an M-shaped configuration or a waved configuration.

* * * * *